US011103760B2

(12) United States Patent
Gódor et al.

(10) Patent No.: US 11,103,760 B2
(45) Date of Patent: Aug. 31, 2021

(54) LINE FAULT DETECTION SYSTEMS AND METHOD FOR DETERMINING WHETHER A SPORT GAMING DEVICE HAS BOUNCED OFF AN AREA OF A SPORTS FIELD

(71) Applicant: Telefonaktiebolaget LM Ericsson (publ), Stockholm (SE)

(72) Inventors: István Gódor, Budapest (HU); Linus Björklund, Torslanda (SE); Bruno Fiter, Lannion (FR); Björn Sandström, Stockholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 21 days.

(21) Appl. No.: 16/479,996

(22) PCT Filed: Mar. 8, 2017

(86) PCT No.: PCT/EP2017/055417
§ 371 (c)(1),
(2) Date: Jul. 23, 2019

(87) PCT Pub. No.: WO2018/162053
PCT Pub. Date: Sep. 13, 2018

(65) Prior Publication Data
US 2019/0366187 A1 Dec. 5, 2019

(51) Int. Cl.
*G08B 5/00* (2006.01)
*A63B 71/06* (2006.01)
*A63C 19/06* (2006.01)

(52) U.S. Cl.
CPC ..... *A63B 71/0605* (2013.01); *A63C 19/065* (2013.01); *A63B 2071/0611* (2013.01); *A63B 2220/806* (2013.01); *A63B 2220/808* (2013.01)

(58) Field of Classification Search
CPC ..... A63B 71/0605; A63B 2071/0611; A63B 2024/0043; A63C 19/065; G01S 11/14; G01S 5/22
See application file for complete search history.

(56) References Cited

U.S. PATENT DOCUMENTS 5,489,886 A * 2/1996 Wexler ..... A63B 71/0605 340/323 R
5,908,361 A * 6/1999 Fisher ..... A63B 63/007 473/467
2017/0186441 A1* 6/2017 Wenus ..... G01S 5/18

FOREIGN PATENT DOCUMENTS

AU 6655386 A * 6/1987 ..... A63B 71/0605
AU 6655386 A 6/1987

(Continued)

*Primary Examiner* — Lawrence S Galka
(74) *Attorney, Agent, or Firm* — Coats + Bennett, PLLC

(57) ABSTRACT

We generally describe an audio-based line fault detection system for a sports game. The audio-based line fault detection system comprises one or more audio sensors (102) for sensing an audio signal generated by a sports gaming device bouncing off a sports field. The sports field comprises surface modifications applied to a line and/or an area adjacent to the line on the sports field such that the generated audio signal is dependent on whether or not the sports gaming device bounces off the sports field where the surface modifications are applied. The detection system is configured to generate a sound profile from the audio signal sensed by the one or more audio sensors (102). The detection system is further configured to identify a bounce type based on the sound profile, wherein the bounce type is defined by whether or not the sports gaming device has bounced off the sports field where the surface modifications are applied.

20 Claims, 9 Drawing Sheets

200

(56) References Cited

FOREIGN PATENT DOCUMENTS

| | | | |
|---|---|---|---|
| DE | 2628908 | A1 | 1/1978 |
| DE | 4100434 | A1 | 7/1992 |
| FR | 2501513 | A1 | 9/1982 |

* cited by examiner

200

300

LINE FAULT DETECTION SYSTEMS AND METHOD FOR DETERMINING WHETHER A SPORT GAMING DEVICE HAS BOUNCED OFF AN AREA OF A SPORTS FIELD

TECHNICAL FIELD

The present disclosure generally relates to an audio-based line fault detection system for a sports game, a sports field comprising surface modifications, a sports facility comprising the audio-based line fault detection system, a method for determining whether a sports gaming device has bounced off a certain area of a sports field, and a computer program product comprising program code portions for performing the method for determining whether a sports gaming device has bounced off a certain area of a sports field.

BACKGROUND

Line fault detection in tennis and other sports is a major concern and has been deeply investigated in the past. The following aspects of the ball are relied upon in most of the line fault detection systems.

Sensors may be installed in the ground or the line itself. These sensors include, for example, piezo electric, magnetic, induction-based or other mechanical pressure sensors.

Alternatively, optical solutions may be provided. One of the most famous systems currently applied at premium tennis courts is the HawkEye® video analysis-based trajectory estimation.

Other optical solutions are based on photo detection methods using, for example, mirror and laser systems which may scan the neighborhood of the line, whereby the interruption of the light, i.e. the light beam, shows the detection.

Balls may also be equipped with active or passive tags that can be followed by anchor nodes with known positions.

An audio-based detection has been used in the art, whereby the construction material of the tennis court, or sports field in general, within certain boundaries (i.e. the lines of, for example, the tennis court) is entirely different from the construction material outside of those boundaries.

For example, DE 41 00 434 A 1 discloses a sports field in which liquid crystals may be implemented in certain areas of the sports field to indicate a line fault. DE 41 00 434 A 1 further describes the use of audio generating devices, i.e. speakers, which may be activated, i.e. triggered, upon an impact of, for example, the sports ball.

However, existing solutions used for line fault detection entail high maintenance and are not always reliable.

Solutions which have made use of sensors installed in the ground or the line itself, optical solutions, active or passive tags incorporated in the sports gaming device or speakers being triggered upon the sports gaming device hitting a certain area of the sports field, may not be as reliable. Furthermore, a problem of these existing solutions lies in the burdensome maintenance of the devices and systems.

For example, it may be hard to maintain sensors which may be installed in the ground or the line itself. Furthermore, heavy construction work may be needed in order to install these sensors in existing courts or sports fields.

When using magnetic and other electric detectors, it may be assumed that the balls are prepared with some conductor or other metal material which might not be acceptable in view of the strict rules in competitive sports regarding equipment being allowed during competitions, in particular in sports games for which such line fault detection may be important.

Optical solutions, such as, for example, laser beam interruption detection, may typically be very sensitive to positioning and may therefore need continuous recalibration. In contrast to theory, it may also be difficult in practice to differentiate, for example, light interruption due to balls (or the sports gaming device in general) or a player, respectively.

Adding tags to balls may be feasible only in those sports, where the ball is heavy and adding a sensor does not significantly change the balance and other parameters of the ball. A tag may therefore be installed, for example, within an ice hockey puck.

However, in tennis, squash or other similar sports, such sensors may not be feasible.

Video-based analysis has widely been used so far, whereby HawkEye (®) has been implemented in, for example, tennis. However, this solution is comparatively expensive and may therefore only be used, for example, at Grand Slam locations and elite clubs which may be able to afford such technologies.

As outlined above, in DE 41 00 434 A 1, an acoustic detection of a line fault is proposed based on an assumption that the construction material of the tennis court, or sports field in general, is different within certain boundaries/lines compared to other parts of the sports field. A sound may be output by a speaker upon the ball hitting certain areas of the sports field. The use of metal plates has been proposed. However, sports fields are extensively used by players, whereby fast accelerations, stops or glides of the players towards the ball may occur. Therefore, metal material and the like may not be allowed to guarantee the safety of the players.

SUMMARY

It is therefore an object of the present disclosure to provide a more reliable line fault detection system.

According to a first aspect of the present disclosure, there is therefore provided an audio-based line fault detection system for a sports game, the audio-based line fault detection system comprising one or more audio sensors for sensing an audio signal generated by a sports gaming device bouncing off a sports field. The sports field comprises surface modifications applied to at least one of a line and an area adjacent to the line on the sports field such that the generated audio signal is dependent on whether or not the sports gaming device bounces off the sports field where the surface modifications are applied. The audio-based line fault detection system is configured to generate a sound profile from the sensed audio signal, and identify a bounce type based on the generated sound profile, wherein the bounce type is defined by whether or not the sports gaming device has bounced off the sports field where the surface modifications are applied.

In some variants, the audio-based line fault detection system further comprises a sound profiler coupled to the one or more audio sensors, wherein the sound profiler is configured to generate the sound profile from the audio signal sensed by the one or more audio sensors. The audio-based line fault detection system further comprises a bounce type identifier coupled to the sound profiler, wherein the bounce type identifier is configured to identify the bounce type based on the sound profile. The bounce type is determined, i.e. defined, by whether or not the sports gaming device has bounced off the sports field where the surface modifications are applied.

The sound profile may, in some examples, be created after digitization of sound waves originating from the sports gaming device bounce.

The main characteristics of the sound waves may be identified and/or analyzed manually directly by experts. Additionally or alternatively, the sound waves may be identified and/or analyzed using machine learning, as will be further described below.

The skilled person will be familiar with how sound waves or sound profiles may be analyzed. For example, the shape of the waves, including but not limited to their amplitude, frequency, phase, amplitude spectrum, frequency spectrum and/or other characteristics may be analyzed. In some variants, the spectrum profile may alternatively or additionally be analyzed regarding any harmonics which may be generated in the sound profile when the sports gaming device bounces off the modified surface. These harmonics may not be generated, or other harmonics with, for example, other frequencies may be generated when the sports gaming device bounces off an area on which no surface modifications have been applied.

The surface modifications may be, for example, small cuts, small holes, or generally small indents, or other surface modifications, such as, for example, small elevations. It will be appreciated that the size of the cuts, holes, indents, elevations, etc. is preferably large enough such that the audio signal which is generated by the sports gaming device, which may be a sports ball, is different when the sports gaming device bounces off a part of the sports field where the surface modifications are applied compared to when the sports gaming device bounces off a part of the sports field where no surface modifications are applied. Furthermore, it will be understood that the size of the surface modifications may, in some instances, be kept below a predefined threshold, such that the trajectory of the sports gaming device may not be influenced by the presence of the surface modifications when the sports gaming device bounces off the sports field. The size of the small cuts, small holes, or generally small indents, or other surface modifications, such as, for example, small elevations, may hereby be chosen based on the type of the sports gaming device used in the sports game.

The surface modifications may, in some variants, alternatively or additionally relate to a particular painting which may include, for example, a dashed painting or a dotted painting. The painting may be chosen such that the players or the spectators of the game may not be physically and/or visually disturbed.

Additional or alternative surface modifications may be applied to the sports field, as will be further outlined below.

It will further be appreciated that the surface modifications may not be limited to a particular shape or pattern. However, it will be understood that certain shapes or patterns may result in audio signals, which may be generated when the sports gaming device bounces off the sports field, which may be particularly distinguishable from an audio signal which is generated when the sports gaming device bounces off the sports field in an area or a location at which no surface modifications have been applied. The audio waves that are reflected when the sports gaming device bounces off the sports field may therefore be different when the sports gaming device bounces off the sports field where surface modifications are applied, compared to the sports gaming device bouncing off the sports field where no surface modifications are applied.

In some variants of the audio-based line fault detection system, the sound profiler and the bounce type identifier are integral to a single unit. Furthermore, in some examples, the sound profiler and the one or more audio sensors may be integral to a single unit. It will be appreciated that, in some variants, the sound profiler, the one or more audio sensors and the bounce type identifier may be integral to a single unit.

In some variants, the bounce type may then be output, such that a decision may be made, based on whether the sports gaming device has bounced off from an area or a location on the sports field which comprises surface modifications, whether a line fault has occurred or not. The decision as to whether a line fault has occurred or not may, in some examples, be made based on the identified bounce type by a human referee. The identified bounce type may hereby be provided to the human referee as a binary information, or other information, based on which the decision as to whether a line fault has occurred or not may then be made by the human referee. The human referee may, in some instances, have previously obtained (via the same or another sports field) any information allowing her/him to make the decision as to whether a line fault has occurred or not based on the bounce type of the current scenario.

In some variants, the audio-based line fault detection system is further configured to determine whether there is a line fault or not based on at least one of a status and a mode of the sports game and the bounce type.

In some variants, the audio-based line fault detection system further comprises a line fault detector which is coupled to the bounce type identifier. The line fault detector may be configured to determine whether a line fault has occurred or not based on a status and/or mode of the sports game and the bounce type identified by the bounce type identifier. The mode of the sports game may, for example, relate to the number of players of the game, such that different lines arranged on the sports field apply. In the example of tennis, if the tennis ball is outside the service line, the ball is out, that means a line fault has occurred, if it is a serve. However, if it is not a serve, but it is a shot during the rally, then the ball is in and no line fault has occurred. The status of the sports game may therefore be determined, for example, by whether the shot is a serve or not. The status and/or mode of the sports game therefore relates to boundary conditions applicable to the sports game which may need to be taken into consideration when determining, based on the bounce type identified by the bounce type identifier, as to whether a line fault has occurred.

In some variants, the audio-based line fault detection system further comprises a game status interface which is configured to indicate the status and/or mode of the sports game and to provide the status and/or mode of the sports game to the line fault detector. The game status interface may hereby be accessible by a human. Additionally or alternatively, the game status interface may be coupled to a virtual referee who may keep track of the status and/or mode of the game. Via the game status interface, the audio-based line fault detection system may thereby know as to whether the actual sports gaming device shot or throw is, in the example of tennis, a serve or not, and/or whether it is a singles or doubles game, etc.

In some variants of the audio-based line fault detection system, the one or more audio sensors are directed substantially towards the surface modifications. The one or more audio sensors thereby focus on, for example, one or more lines in question. It will be appreciated that the one or more audio sensors being directed substantially towards the surface modifications may be understood as the one or more sensors being directed generally in a direction facing towards the surface modifications. The one or more sensors may hereby not necessarily be directed exactly towards the surface modifications, but one or more of the one or more sensors may be arranged such that they are configured to detect an audio signal coming from an area which encompasses the area where the surface modifications are applied. An audio signal generated in the area (or close to the area) where the surface modifications are applied may therefore be sensed with a higher intensity compared to an audio signal having the same amplitude but being generated further away from the area where the surface modifications are applied.

In some further variants, the audio-based line fault detection system is configured to generate a plurality of sound profiles, wherein one of the sound profiles is generated from the audio signal sensed by a corresponding, respective audio sensor. The audio-based line fault detection system is further configured to select one or more of the sound profiles based on one or more characteristics of at least one of the audio signals and the sound profiles. The audio-based line fault detection system is further configured to identify the bounce type based on the selected sound profile.

In some variants, the audio-based line fault detection system further comprises a bounce profile database which is coupled to the bounce type identifier. The bounce profile database is, in these variants, configured to store one or more characteristics of one or more bounce types. The bounce type identifier is further configured to identify the bounce type based on the one or more characteristics of the one or more bounce types. The bounce profile database may hereby contain all types of sound prole which may be relevant for the given court in order for the audio-based line fault detection system to be able to differentiate the different ball bounce audio events. In some examples, one of the one or more characteristics of the one or more bounce types may comprise a plurality of variants, such as a range of a characteristic (for example a strength of the bounce), for the corresponding bounce type. In some examples, this may allow the audio-based line fault detection system to separate different strengths of the bounce.

In some variants, the audio-based line fault detection system further comprises a bounce type learning unit which is configured to learn, based on the sound profile, what bounce type was identified by the bounce type identifier. This functionality may be based on machine learning, where a supervised learning may be needed to build up an initial reference bounce profile database. Once the reference database has been created, an unsupervised machine learning technique may be used to automatically categorize the actual balance detected. In some examples, the game status interface may hereby be coupled to the bounce type learning unit. The bounce type learning unit may hereby be configured to learn, based on the status and/or mode of the sports game, what bounce type was identified.

In some variants, the audio-based line fault detection system further comprises one or more optical sensors (which may be, for example, one or more video sensors and/or one or more image sensors) configured to capture at least one of a video and images of the sports field (or at least a part thereof), and a frame selector coupled to the one or more optical sensors. The frame selector may hereby be configured to extract at least one of a frame from the video and a sequence from the images, wherein the frame and/or sequence comprises parts of the video or images captured before and after the sports gaming device bouncing off the sports field. The audio and video/image information may hereby be combined in order to determine as to whether a line fault has occurred or not.

The one or more video or image sensors and/or the frame selector may, in some examples, be triggered by the sports gaming device crossing a light barrier. Additionally or alternatively, the frame selector may further be coupled to the one or more audio sensors and/or the sound profiler. The frame selector may then be configured to extract the frame from the video or the sequence from the images in response to the audio signal being sensed by the one or more audio sensors and/or the sound profile being generated by the sound profiler. In some examples, the one or more videos may be recorded continuously or the one or more images may be taken in a continuous manner with predefined time periods in between, and the audio signal being sensed by the one or more audio sensors and/or the sound profile being generated by the sound profiler may be used as a trigger for the frame selector to extract the frame from the video or sequence from the images which include parts before and after the sports gaming device has bounced off the sports field.

The one or more audio sensors and/or the sound profiler may hereby be time-synchronized with the one or more video or image sensors. This may be achieved, for example, via time synchronization between components or via maintaining a wall-clock time.

It will be appreciated that, similar to the one or more audio sensors, the one or more video or image sensors may be directed towards one or more lines (or areas) on which and/or adjacent to which the surface modifications are applied.

In some variants, the audio-based line fault detection system further comprises an analyzer (which may be, for example, a frame analyzer or a sequence analyzer) configured to determine, from the frame and/or sequence, a location on the sports field on which the sports gaming device has bounced off. The video frame or sequence of images may hereby be provided to the human referee. Additionally or alternatively, in some examples, the video frame or sequence of images may be used for an interpolation between two parts of the video frame or between images of the sequence in order to determine the actual bounce location. This information may also be provided to the human referee and/or the players of the sports game.

In some variants, the analyzer is configured to determine the location on the sports field on which the sports gaming device has bounced off based on an interpolation using the frame extracted from the video or the sequence extracted from the images, and further using speed information of the sports gaming device before and after the bounce. The speed information of the sports gaming device may hereby be obtained via the one or more optical sensors of the audio-based line fault detection system, or via other optical sensors. In some examples, based on statistical measurements done in the sports field, the flexibility of the sports field and the sports gaming device may be measured, such that the difference in speed of the sports gaming device before and after the bounce may be determined, which may be taken into consideration for the interpolation.

In some variants of the audio-based line fault detection system, the sound profiler and/or the bounce type identifier are cloud-based.

In alternative implementations of the audio-based line fault detection system, one or more of the frame selector, the frame analyzer, the sound profiler, the bounce type identifier, the bounce learning unit, the bounce profile database and the line fault detector are cloud-based. The audio-based line fault detection system is then configured to perform one or more of the functions of the frame selector, the frame analyzer, the sound profiler, the bounce type identifier, the bounce learning unit, the bounce profile database and the line fault detector as described herein with regard to one or more of the variants of the audio-based line fault detection system.

In some variants of the audio-based line fault detection system, the one or more audio sensors are configured to provide the sensed audio signal(s) to the sound profiler in a compressed format. In variants, in which the sound profiler is cloud-based, the one or more audio sensors are configured to provide the sensed audio signal(s) to the cloud, where the sound profile(s) may then be generated.

In a related aspect of the present disclosure, there is provided a sports field comprising surface modifications applied to a line and/or an area adjacent to the line on the sports field such that an audio signal generated by a sports gaming device bouncing off the sports field is dependent on whether or not the sports gaming device bounces off the sports field where the surface modifications are applied.

In a further related aspect of the present disclosure, there is provided a sports facility comprising the audio-based line fault detection system as outlined in any one of the variants as described herein. The sports facility further comprises the sports field comprising surface modifications applied to a line and/or an area adjacent to the line on the sports field. An audio signal generated by a sports gaming device bouncing off the sports field may hereby be dependent on whether or not the sports gaming device bounces off the sports field where the surface modifications are applied.

As outlined above, the surface modifications may be, for example, small cuts, small holes, or generally small indents or other surface modifications, such as, for example, surface elevations. It will be appreciated that the size of the cuts, holes, indents, elevations, etc. should be large enough such that the audio signal which is generated by the sports gaming device, which may be a sports ball, is different when the sports gaming device bounces off a part of the sports field where the surface modifications are applied compared to when the sports gaming device bounces off a part of the sports field where no surface modifications are applied. Furthermore, it will be understood that the size of the surface modifications may, in some instances, be kept below a predefined threshold, such that the trajectory of the sports gaming device may not be influenced by the presence of the surface modifications when the sports gaming device bounces off the sports field.

It will further be appreciated that the surface modifications may not be limited to a particular shape or pattern. However, it will be understood that certain shapes or patterns may result in audio signals, which may be generated when the sports gaming device bounces off the sports field, which may be particularly distinguishable from an audio signal which is generated when the sports gaming device bounces off the sports field in an area or a location at which no surface modifications have been applied.

In a further related aspect of the present disclosure, there is provided a method for determining whether a sports gaming device has bounced off an area (i.e. a particular area) of the sports field. The area comprises surface modifications such that an audio signal generated by the sports gaming device bouncing off the sports field is dependent on whether or not the sports gaming device has bounced off the area of the sports field on which the surface modifications have been applied. The method comprises sensing an audio signal generated by the sports gaming device bouncing off the sports field, generating a sound profile from the sensed audio signal, and identifying the bounce type based on the generated sound profile. The bounce type is defined by whether or not the sports gaming devices bounces off the sports field where the surface modifications have been applied.

It will be understood that the variants of the audio-based line fault detection system as described herein may equally by applied to the method in order to obtain variants of the method with additional functionalities.

It will be appreciated that the variants of the audio-based line fault detection system as described herein may not only be applied to a horizontal sports field, such as, for example, a tennis court, but may also be applied to sports fields which are at an angle to the horizontal orientation, or which may be vertical (for example in a squash game, in which both horizontal and vertical walls are used).

In a further related aspect of the present disclosure, there is provided a computer program product comprising code portions for performing variants of the method as described herein when the computer program product is executed on one or more computing devices. The computer program product may hereby be stored on a computer-readable recording medium.

BRIEF DESCRIPTION OF THE DRAWINGS

These and other aspects of the present disclosure will now be further described, by way of example only, with reference to the accompanying figures, wherein like reference numerals refer to like parts, and in which.

DETAILED DESCRIPTION

Variants of the present disclosure allow eliminating shortcomings of the above acoustical or optical detection methods used in the art. The audio processing methodology generally as described herein may be applied for detecting line faults without need to apply mechanically different materials inside and outside of the game field.

The proposed solution may generally be based on minor modifications to the surface close to, for example, the line which indicates the border of the game field, where the sound of the ball bounce may be differentiated by an automated decision-making based on sound pattern recognition, machine learning or similar technologies.

Surface modifications may be applied to the surface of the sports field in the form of, for example, small cuts, small holes, or generally small indents or elevations, etc. which may not change the mechanical behavior of the sports field such that no negative interference with the players' safety occurs. Meanwhile, the sound pattern of the ball bounce may be differentiated by a computer aided system.

When installing a sports field, the material may be different inside and outside of certain boundary lines. Alternatively or additionally to the above-described surface modifications, the rigidity of the surface, which may be a rubber surface, may be different in different areas of the sports field. Alternatively or additionally, a cavern style underground building may be provided outside of the lines of the sports field which may result in an echo type sound which may be generated in the sound profile.

Additionally, the system may be combined with a video hint module, which may extract the moment just before and after the bounce based on an audio trigger, so that a human referee or a computer-aided system may decide whether the ball is inside or outside the considered line or game field.

Figure 1:
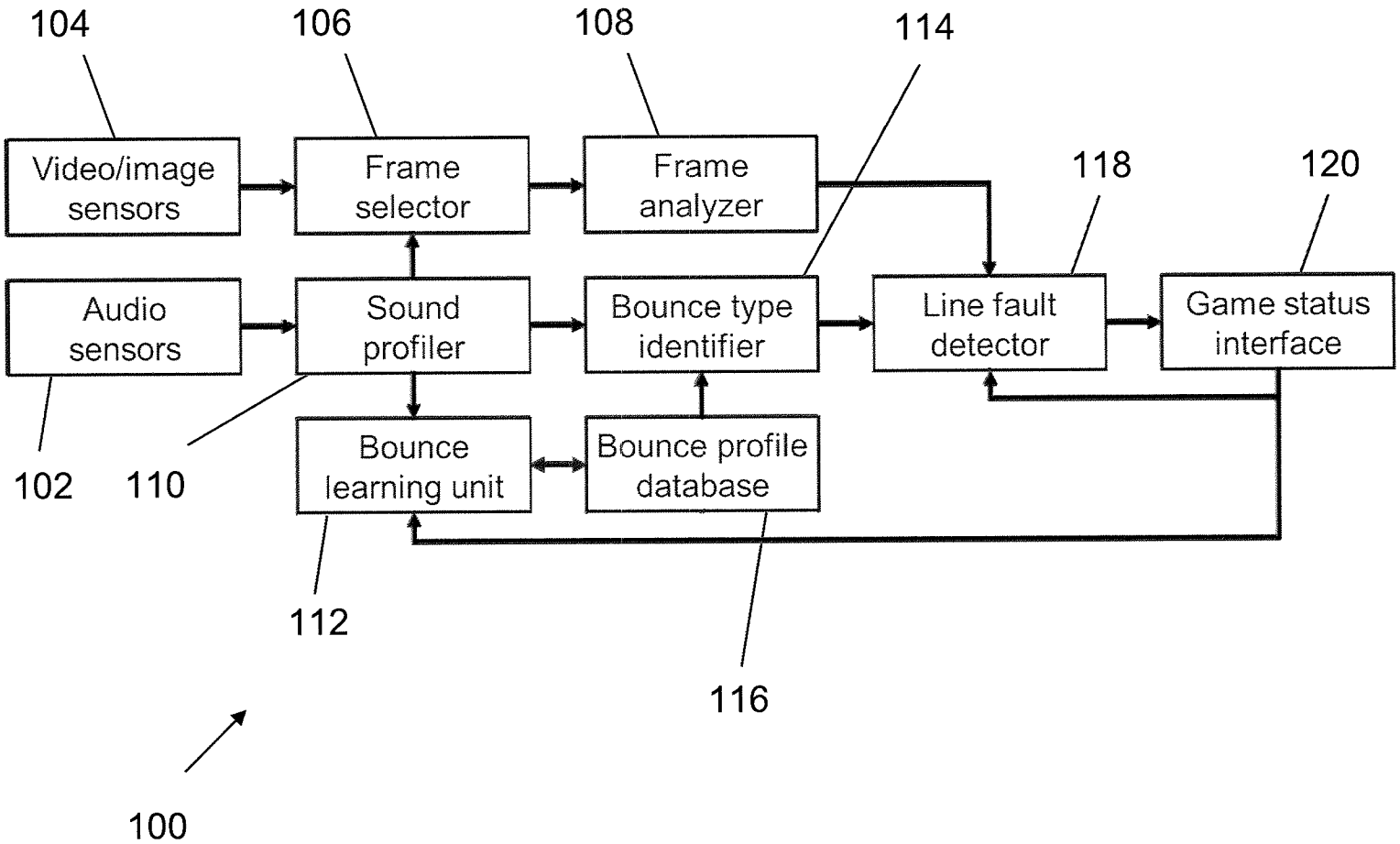
FIG. 1 shows a schematic block-diagram of an audio-based line fault detection system according to some variants of the present disclosure.

FIG. 1 shows a schematic block-diagram of a computer-aided system which may be implemented as an audio-based line fault detection system 100 according to some variants of the present disclosure.

In this example, audio sensors 102 are provided which may capture the sound of the ball bounce. In some examples, the audio sensors 102 are microphones.

The audio sensors 102 may, in some examples, focus on the neighborhood of one or more lines in question.

The audio sensors 102 may be configured to compress the audio signals, for example, in a lossless way, in case of bandwidth limitation. That means that all relevant characteristic information of the audio signal may be intact, which may be important for the sound profiler functionality.

In this example, the audio sensors 102 are coupled to the sound profiler 110. The sound data, which may be analogue or digital, may therefore be provided from the audio sensors 102 to the sound profiler 110. The sound profiler 110 may then create, in this example, a characteristic, i.e. a sound profile, from the sound data per audio sensor. The sound profile may hereby comprise information regarding the shape of the sound wave around the ball bounce, its amplitude, its frequency profile which may be based on a Fourier or other transformation, or other characteristics of the sound wave. The sound profile which has been generated by the sound profiler 110 may then be forwarded to the bounce type identifier 114 which is coupled to the sound profiler 110.

In this example, the sound profiler 110 is further coupled to the bounce learning unit 112 such that the sound profile is also forwarded from sound profiler 110 to the bounce learning unit 112.

Furthermore, in this example, the sound profiler 110 is also coupled to the frame selector 106 such that the sound profile generated by the sound profiler 110 may be forwarded to the frame selector 106.

The bounce type identifier 114 may be configured to find the best matching bounce type based on the audio signal detected by the audio sensors 102 and/or the sound profile generated by the sound profiler 110, and further, in this example, based on the historical bounce profile database 116. The bounce profile database 116 is, in this example, coupled to the bounce type identifier 114 and the bounce learning unit 112.

Providing a bounce profile database 116 may be preferable as various characteristics of the different bounce types may be stored and taken into consideration when the determination of the bounce type and/or the determination as to whether a line fault has occurred or not is made.

Preferably, the one or more characteristics of the bounce types comprise a plurality of variants for the corresponding bounce types, such that, for example, the strength of the bounce may be taken into consideration when the bounce type is determined.

It may be advantageous for the audio-based line fault detection system to be configured to select the sound profile generated from the audio signal sensed by a particular one of the audio sensors based on one or more characteristics of the audio signal and/or the sound profile. The determination regarding the bounce type and/or the determination as to whether a line fault has occurred or not may be particularly precise or accurate based on a particular audio signal from a particular audio sensor. The particular audio sensor may hereby be selected based on, for example, the amplitude of the audio signal and/or the frequency or frequency spectrum of the audio signal, which may provide for a more accurate analyzation of the bounce type and/or the line fault determination.

It will be appreciated that the audio signal from more than one audio sensor may hereby be selected in order to determine the bounce type. This may further improve accuracy of the determination of the bounce type, and hence the determination as to whether a line fault has occurred or not.

In this example, the bounce type identifier 114 is coupled to the line fault detector 118 such that the bounce type identifier 114 may inform the line fault detector 118 about the location of the bounce.

It may be particularly advantageous to provide a line fault detector 118 in the audio-based line fault detection system, as the determination as to whether a line fault has occurred or not may be automated, rather than, for example, a human referee having to make a decision based on the bounce type and the status and/or mode of the sports game.

Based on information incorporated in the sound profile, the bounce type identifier 114 is, in this example, configured to determine which one or more audio sensors of the audio sensors 102, which may be microphones, have detected the ball bounce best. This determination by the bounce type identifier 114 may, in some variants of the audio-based line fault detection system, be based on the amplitude of the audio signals sensed by the audio sensors 102. However, it will be appreciated that, additionally or alternatively, other characteristics of the audio signals sensed by the audio sensors 102 and/or the sound profile generated by the sound profiler 110 based on each of the audio signals may be used by the bounce type identifier 114 in order to determine which one or more of the audio sensors 102 has detected the ball bounce best. It will further be understood that the determination as to which one or more of the audio sensors 102 has detected the ball bounce best may be performed by the sound profiler 110, and/or another unit of the audio-based line fault detection system.

Based on the determination as to which one or more of the audio sensors 102 has detected the ball bounce best, the bounce type identifier 114 (and/or another unit of the audio-based line fault detection system) is, in this example, configured to decide which line or lines should be considered when determining as to whether the ball was inside or outside of the given line or lines.

In this example, in which the bounce type identifier 114 is configured to determine which one or more of the audio sensors 102 has detected the ball bounce best, based on information stored in the bounce profile database 116, the bounce type identifier 114 may further be able to determine as to whether the ball was inside or outside of the given line(s).

As outlined above, in this example, the bounce type identifier 114 is coupled to the line fault detector 118. Furthermore, in the example shown in FIG. 1, the line fault detector 118 is further coupled to the game status interface 120.

In this example, a feedback from the game status interface 120 is provided to the line fault detector 118. This may allow for a more precise or accurate determination by the line fault detector 118 as to whether a line fault has occurred or not.

Given the actual status and/or mode of the game and the bounce type, the line fault detector 118 is, in this example, configured to determine as to whether a line fault has occurred or not.

Merely for illustration, the two following examples of decision trees may be implemented in practice, in this example, for tennis and volleyball. It will be appreciated that other sports may have other rule sets which may not affect the main logic of the functionality of the line fault detector 118.

In the example of tennis, it may have been determined based on the bounce type that the ball is outside the singles side line. The status and/or mode of the game may hereby, for example, indicate whether the current game is a single game or a double game. If the current game is a single game, in the present scenario in which it has been determined that the ball is outside the singles side line, the line fault detector 118 is configured to determine based on the ball being out that a line fault has occurred.

If it is a double game, there are more options. If the shot relates to a serve, then the line fault detector 118 is configured to determine based on the ball being out that a line fault has occurred. Otherwise, if the shot relates to another shot during rally, the line fault detector 118 is configured to determine based on the ball being in that no line fault has occurred.

In a further scenario in tennis, it may have been determined based on the bounce type that the ball is outside the service line. If the shot relates to a serve, the line fault detector 118 is configured to determine based on the ball being out that a line fault has occurred. Otherwise, if the shot relates to another shot during rally, the line for detector 118 is configured to determine based on the ball being in that no line fault has occurred.

In a volleyball game scenario, it may have been determined based on the bounce type that the ball is outside the baseline (that is the back line of the volleyball court). The status and/or mode of the game which may be fed by the game status interface 120 into the line fault detector 118 may relate to whether the team playing on the side corresponding to the baseline has touched the ball or not. If the team playing on the side corresponding to the baseline touched the ball, then the ball is outside and the point/serve goes to the other team. If the team playing on the side corresponding to the baseline did not touch the ball, then the ball is outside and the point/serve goes to this team, which may be determined by the line fault detector 118 based on the bounce type and the status and/or mode of the game.

The game status interface 120 may, in some examples, be "connected to" a human referee keeping the score and status and/or mode of the game. The human referee may hereby be provided with, for example, a touch display or other device into which the human referee may input the status and/or mode of the game. Alternatively or additionally, the game status interface 120 may be coupled to a virtual referee keeping the score and status and/or mode of the game. The audio-based line fault detection system 100 may be provided with information, such as, for example, whether the actual ball shot is a serve or not, whether it is a singles or doubles game, etc., via the game status interface 120.

Based on the status and/or mode information and the line fault detector 118 functionality, the actual game status and/or mode may be modified in the virtual referee solution (for example, a display panel, etc.) and/or this information may be shared with the human referee to help him/her make a decision.

As shown in FIG. 1, the game status interface 120 is further coupled to the bounce learning unit 112.

In this example, the bounce learning unit 112 is configured to learn what type of bounce was detected based on the actual status and/or mode of the game and the sound profile. This functionality may be based on machine learning (ML), where a supervised learning may be needed to build up an initial reference bounce profile database. Once the reference database has been completed, unsupervised machine learning techniques may be sufficient to automatically categorize the actual bounce detected.

Using the bounce learning unit 112, the audio-based line fault detection system may accumulate data over time in order to provide for a more precise or accurate determination of the bounce type, and hence a more accurate determination as to whether a line fault has occurred or not. Preferably, the bounce learning unit 112 is hereby coupled to the game status interface 120 of the audio-based line fault detection system, such that the machine learning process may be improved as an input of the status and/or mode of the game is provided to the bounce learning unit 112.

Furthermore, the reference database may be obtained from one or more other sports fields which may have the same physical layout as the sports field under consideration. Hence, if a sports facility or sports court manufacturer may have multiple courts with the same or similar physical parameters, it may be sufficient to create the reference database only once. This information may also be used by the human referee or the player(s) in order to determine whether a line fault has occurred or not.

It will be appreciated that, compared to speech recognition, this machine learning task may be much simpler as the decision may be limited to "yes" or "no" questions, or computationally, the actual bounce sample may be more similar to the outside reference sound or the inside reference sound.

In this example, the bounce profile database 116 is coupled to the bounce type identifier 114 and bounce learning unit 112.

The bounce profile database 116 may contain all types of sound prole which may be relevant for the given court so that different ball bounce audio events may be differentiated. The bounce profile database 116 may hereby, in some examples, contain multiple variants for a given bounce type, for example, to separate different strengths of bounce. It will be appreciated that other characteristics of a bounce may be contained in the bounce profile database 116.

As outlined above, variants of the present disclosure may be applied to a sports field which comprises minor surface modifications and allows for an automated audio-based decision making for line fault evaluation.

Complementary to audio sensors, video sensors and related video hint functionalities may be provided in the audio-based line fault detection system, whereby, in some examples, the audio-related components may trigger the video processing, in contrast to existing standalone video-based line fault detection systems.

The video hint module may hereby extract the moment just before and after the bounce based on the audio trigger, such that a human referee or a computer-aided system may be able to decide as to whether the ball is inside or outside the considered line or game field.

In the example shown in FIG. 1, the audio-based line fault detection system 100 comprises video/image sensors 104.

The video and/or image sensors 104 may hereby be used to capture with a video or photo device the image of the court or game field.

Providing one or more video and/or image sensors 104 may allow for a more accurate determination of the bounce type, and hence a more accurate determination as to whether a line fault has occurred or not.

It may be important to maintain a timestamping in sync with the audio sensors 102 and/or the sound profiler 110. This may be achieved, in some examples, via time synchronization between the components or via maintaining a wall-clock time. It will be appreciated that it may be sufficient to keep the precision at a level at which the corresponding video frames or image sequences may be unambiguously identified based on the timestamp given by the sound profiler 110 to the frame selector 106 to which the sound profiler 110 and the video/image sensors 104 are coupled in this example.

It will be understood that, similar to the case of the audio sensors 102, multiple video/image sensors 104 may focus on different parts of the court or game field, providing for corresponding advantages as those outlined above with regard to the audio sensors 102 pointing in one or more specific directions, for example along the line or lines of the sports field of interest.

Based on the video and/or images input from the video/image sensors 104 and the timestamp of the ball bounce coming from the sound profiler 110, the frame selector 106 is, in this example, configured to select two or three video frames which may be relevant to judge in order to determine as to whether the ball bounced inside or outside of a given line (i.e. at one side, another side or on top of the line).

In some examples, the bounce/timestamp may be in the middle between two frames. In the first frame, the moment right before the bounce may be visible, and in the second frame, the moment right after the bounce may be visible. If the bounce/timestamp is rather close to a given video frame or sequence of images, then both neighboring frames may be selected, thereby forming three frames.

One or more frames obtained via the frame selector may, in some variants, be output, for example, to a human referee who will then be able to determine from the images or video frames alone, or in addition to the audio-based analysis, as to whether a line fault has occurred or not.

In some variants, the frame selector 106 is coupled to the one or more audio sensors 102 and/or the sound profiler 110. The frame selector 106 is then configured to extract the frame from the video or the sequence from the images in response to the audio signal being sensed by the one or more audio sensors 102 and/or the sound profile being generated by the sound profiler 110. The sensing of the audio signals by the one or more audio sensors 102 and/or the generation of the sound profile by the sound profiler 110 may hereby be used as a trigger for the frame selector 106 to select one or more frames and/or images which may be relevant to the determination of the bounce type, and hence to the determination as to whether a line fault has occurred or not.

In this example, the frame selector 106 is coupled to a frame analyzer 108. This may be preferable as the determination of the bounce type may further be automated, rather than the frame(s) or images extracted by the frame selector 106 being provided to, for example, a human referee.

It will be appreciated that the frame analyzer used to analyze a frame from the video provides for the corresponding functions as the sequence analyzer used to analyze images from the sequence of images.

In some examples, it may be assumed that the video/image sensors 104 are well-positioned. In this case, each pixel on a frame may be mapped to an exact location on the court or game field. The frame analyzer 108 is, in this example, configured to decide whether, in the frame pairs or triplets of each video or sequence of images, the ball was on one or another side of the line or crossed the line at all. If the ball is on the same side of the line in all selected frames, then this side is where the ball has bounced. If multiple sides of the line are identified by the frame analyzer 108, then a decision should be made. This decision may be made by either highlighting this situation together with the video frame or the sequence of images to the human referee, or it may be based on an interpolation between the two frames (where due to the closeness in time, simple trajectory estimations may be applied, which may be linear or ballistic). The actual bounce location may then be identified or at least a hint may be given to the human referee or to the player or players.

Based on statistical measurements done in the court, the flexibility of the court and the balls may be measured, such that the difference between the speed of the ball before and after the bounce may also be known, which may be taken into consideration in the interpolation.

The frame analyzer 108 is further coupled to the line fault detector 118 such that the line fault detector 118 may be configured to determine as to whether a line fault has occurred or not based on information provided by the frame analyzer 108.

In some variants of the audio-based line fault detection system, extensions to the audio sensors 102, the sound profiler 110 and the line fault detector 118 may be provided in order to support the video hints.

In one example of an audio sensors extension, either the audio sensors 102 themselves or the sound profiler 110 functionality may maintain a timestamping kept in sync with the video frames and/or sequence of images. This may be achieved either via a time synchronization between the components or via maintaining a wall-clock time. It may hereby be sufficient to keep the precision at a level at which the corresponding video frames and/or sequences of images may be unambiguously identified based on the timestamp given to the frame selector 106.

In one example of a sound profiler extension, as described above, the output of the sound profiler 110 may also include the timestamp of the ball bounce event which may be needed by the frame selector 106.

In one example of a line fault detector extension, the frame analyzer 108 may forward the relevant frames to this functionality, which may be forwarded to the game status interface 120 together with the optionally provided automatic visual ball bounce location information. This information may then be correlated with the judgement coming from the bounce type identifier 114, such that a better (more reinforced) decision may be made. Furthermore, if more video/image sensors 104 may be relevant, multiple views may be utilized.

Figure 2:
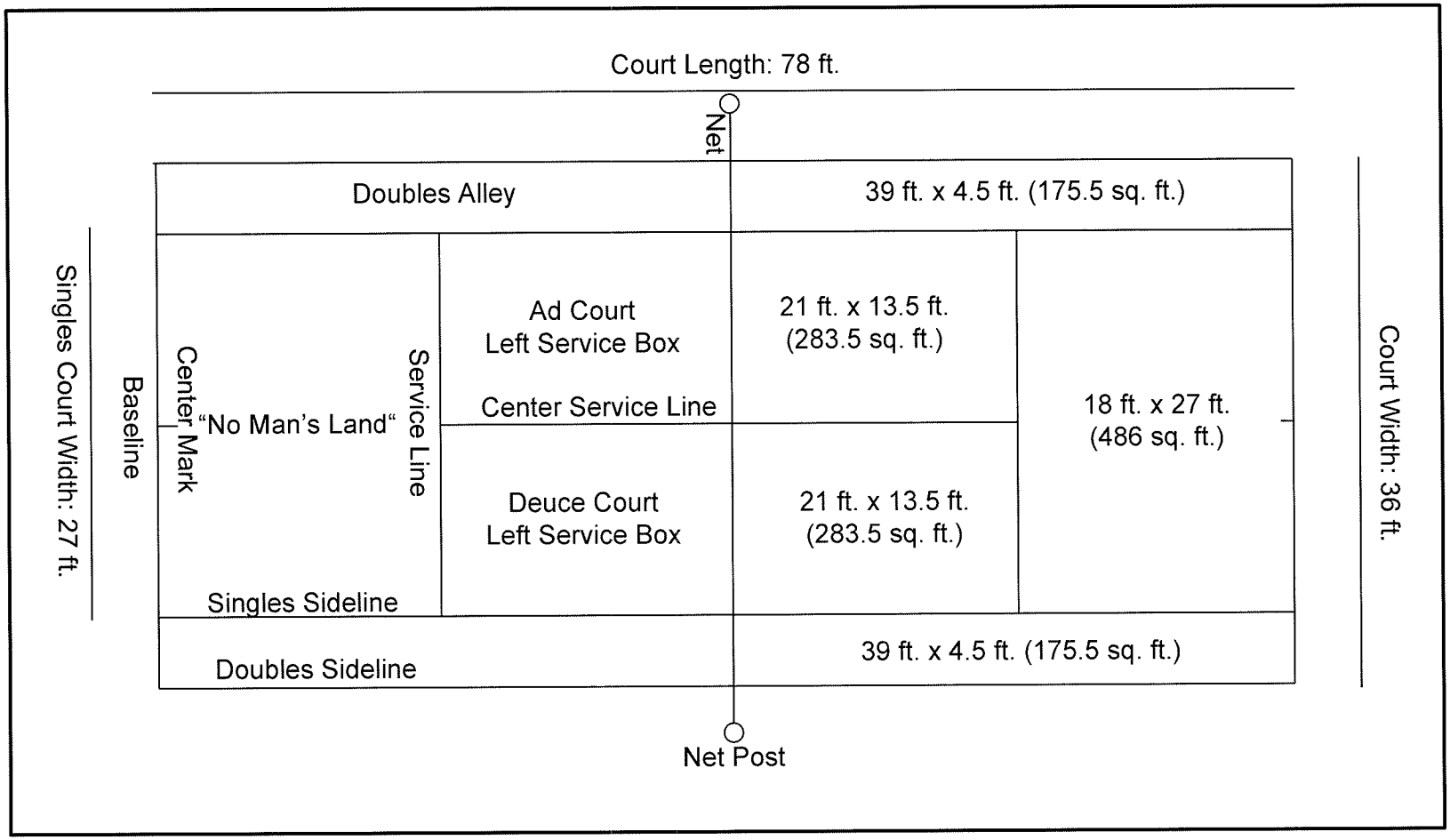
FIG. 2 shows a schematic illustration of a tennis court at which the audio-based line fault detection system according to some variants of the present disclosure may be implemented.

FIG. 2 shows a schematic illustration of a sports field 200, which is in this example a tennis court, at which the audio-based line fault detection system according to some variants as described herein may be implemented.

The tennis court depicted in FIG. 2 shows what lines may be of interest for line fault detection. Similar lines may be of interest in other sports. It will be appreciated that surface modifications may be applied, for example, to the white lines as shown in FIG. 2, and/or in the areas adjacent to those lines. The audio sensors 102 may hereby focus on these lines of interest.

As outlined above, the surface modifications which may be applied to the white lines and/or in the areas adjacent to those lines may, in some examples, include small cuts, small holes, other small indents or elevations, etc., which may not change the mechanical behavior of the field such that the players' safety may be guaranteed.

It will be appreciated that different lines may be of interest during serves, during the rally, in case of single or double games, etc. It would be beyond the scope of the present disclosure to describe all combinations in order to determine which lines may be of interest, which will however be straightforward for tennis players and referees.

The floor of the tennis court may be modified on the outer side of the lines in order to detect questionable ball bounces close to the lines. The audio sensors 102 may be directed alongside the lines. This may be preferable as the determination of the bounce type and/or the determination as to whether a line fault has occurred or not may be more accurate due to the one or more audio sensors 102 focusing on the areas of the sports field of interest.

The solution may equally work without directed audio sensors 102, but more audio sensors 102 may be needed in order to capture the bounces with sufficient sound quality.

Figure 3:
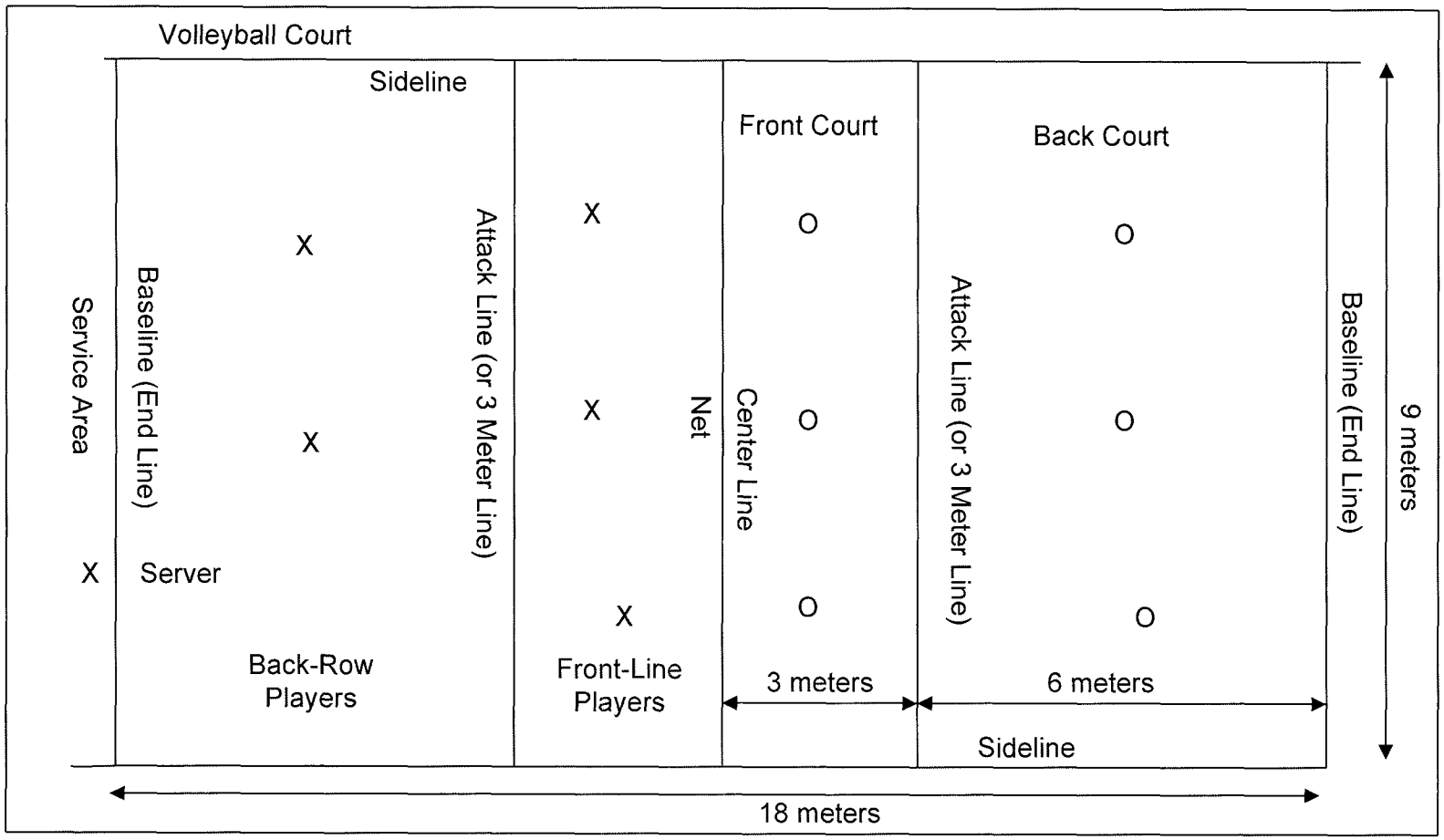
FIG. 3 shows a schematic illustration of a volleyball court at which the audio-based line fault detection system according to some variants of the present disclosure may be implemented.

FIG. 3 shows a schematic illustration of a sports field 300, which is in this example a volleyball court, at which the audio-based line fault detection system according to some variants as described herein may be implemented.

The main lines of the volleyball court that may be targeted via the audio-based line fault detection system according to the samples as described herein are shown in FIG. 3.

As in the case of tennis, the floor of the volleyball court may be modified on the outer side of the lines in order to detect questionable ball bounces close to the lines. The audio sensors 102 may be directed alongside the lines. Similar to the above example of the tennis court, the solution may equally work without directed audio sensors 102, but more audio sensors 102 may be needed in order to capture the bounces with sufficient sound quality.

There are multiple variants of the audio-based line fault detection system in which parts of the system are moved to the cloud. One advantage of moving some functionalities of the audio-based line fault detection system to the cloud is to reduce computational needs on site. It will be appreciated that audio or video analysis parts may be moved independently to the cloud. In the present disclosure, the examples are limited to variants in which respective audio or video analysis parts are moved together.

Figure 4:
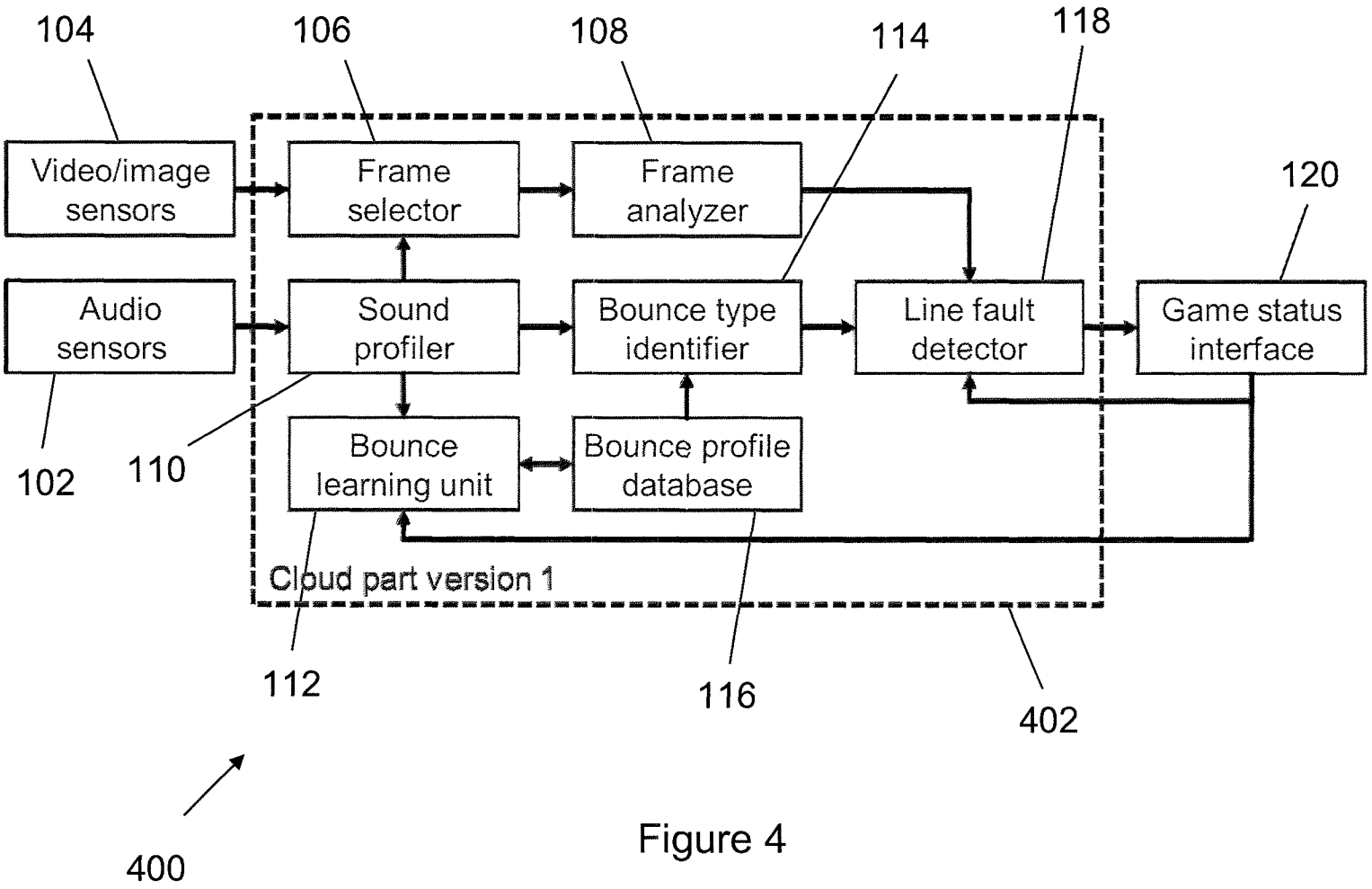
FIG. 4 shows a schematic block-diagram of an audio-based line fault detection system according to some variants of the present disclosure.

FIG. 4 shows a schematic block-diagram of an audio-based line fault detection system 400 according to some variants as described herein.

In this example implementation, the functionalities of the frame selector 106, the frame analyzer 108, the sound profiler 110, the bounce type identifier 114, the line fault detector 118, the bounce learning unit 112 and bounce profile database 116 are moved to the cloud as a cloud part 402.

The functionalities of the audio sensors 102, the video/image sensors 104 and the game status interface 120 remain at the court or sports field.

In this version, when the sound profiler 110 is moved to the cloud, it may be useful to extend the audio sensor functionality not only to forward the raw audio data, but a compression may be applied to the audio signal which may preserve all the characteristics of the audio signal which may be important for the sound profiler 110. This extension may be needed to save bandwidth during the communication with the cloud, if necessary.

Figure 5:
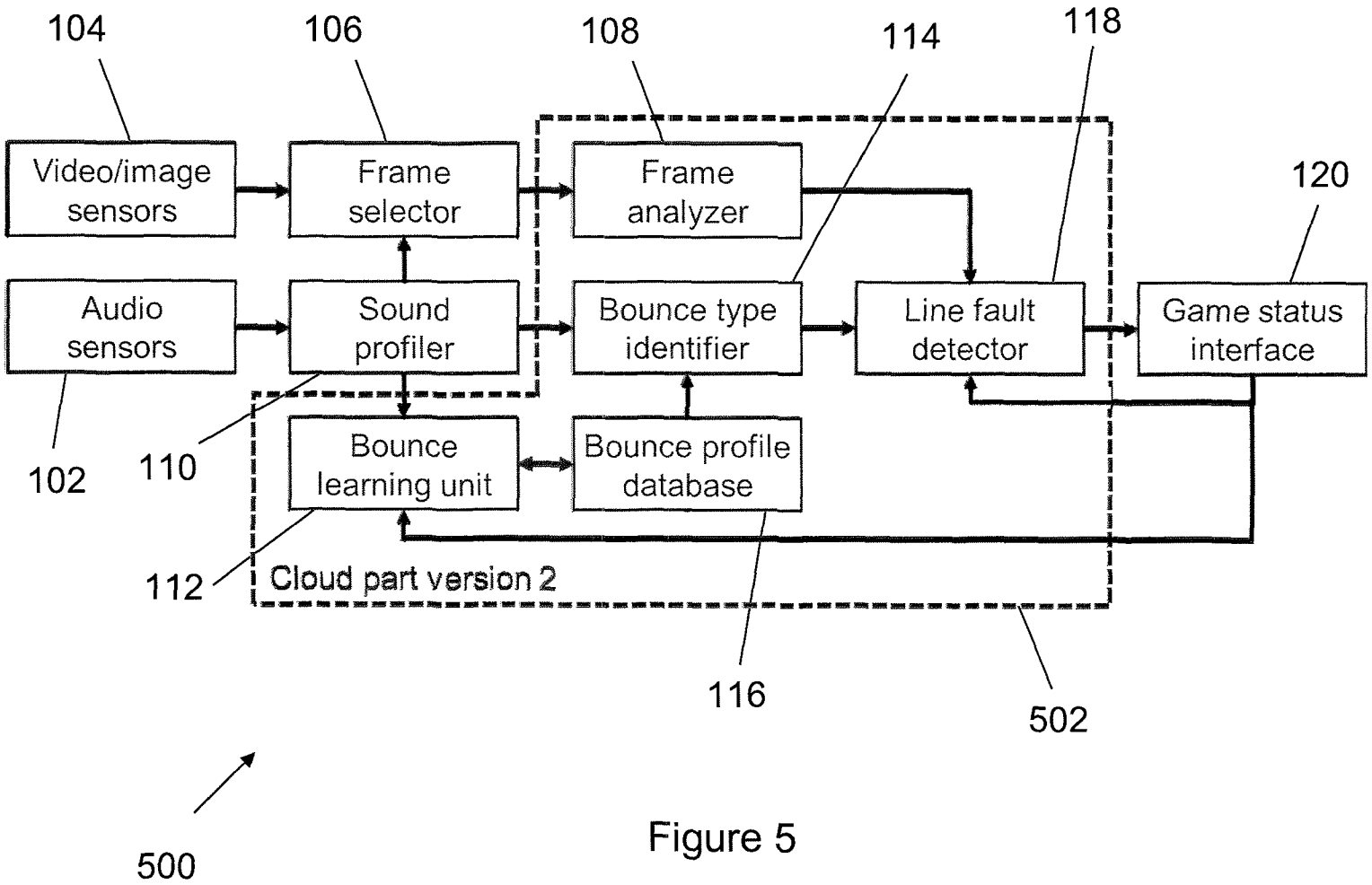
FIG. 5 shows a schematic block-diagram of an audio-based line fault detection system according to some variants of the present disclosure.

FIG. 5 shows a schematic block-diagram of an audio-based line fault detection system 500 according to some variants as described herein.

In this example implementation, the audio sensors 102, the video/image sensors 104, the sound profiler 110, the frame selector 106 and the game status interface 120 remain on site. The cloud part 502 comprises, in this example, the frame analyzer 108, the bounce type identifier 114, the line fault detector 118, the bounce learning unit 112 and bounce profile database 116. This may significantly reduce the amount of data to be transferred to the cloud.

Figure 6:
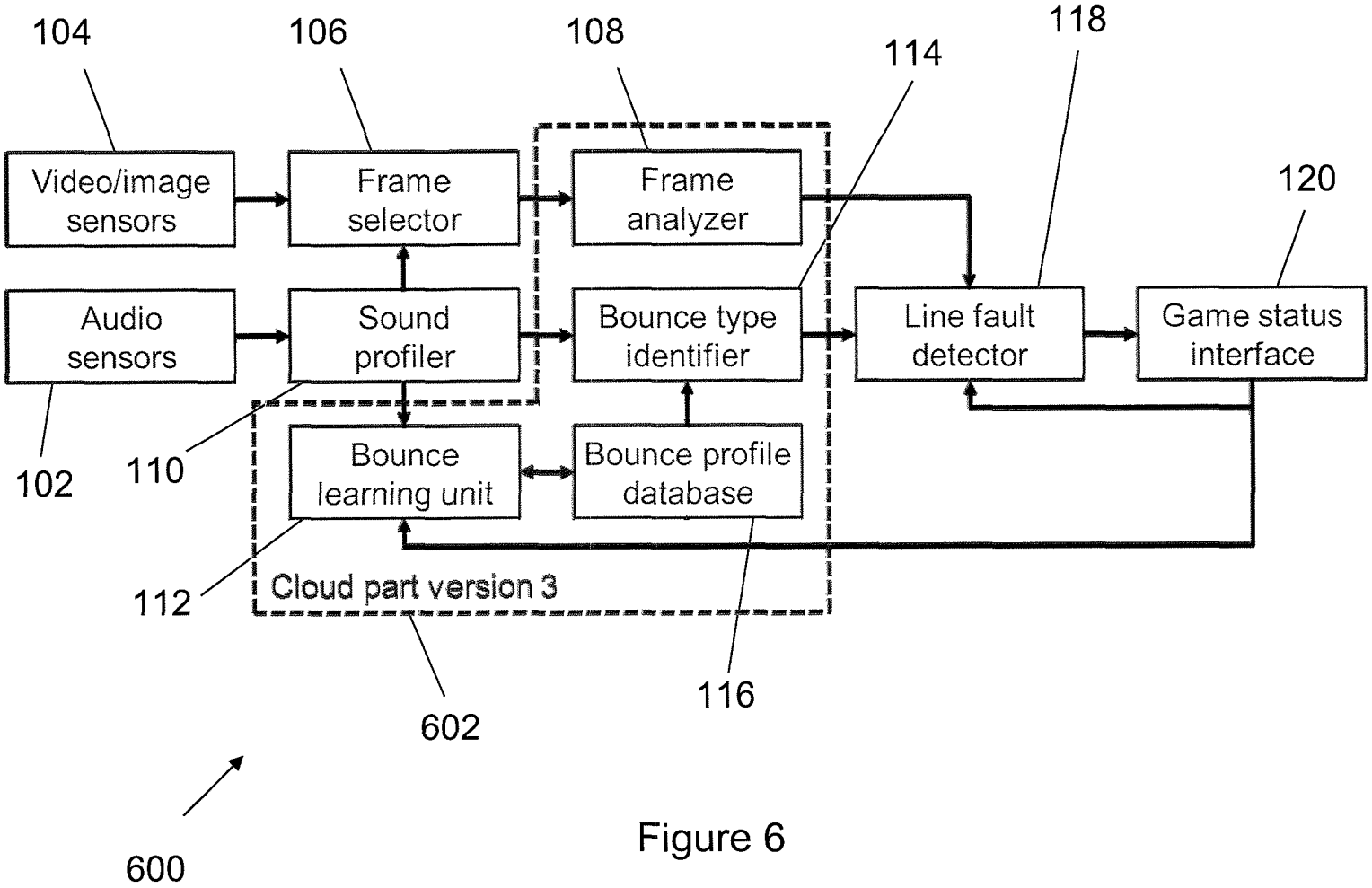
FIG. 6 shows a schematic block-diagram of an audio-based line fault detection system according to some variants of the present disclosure.

FIG. 6 shows a schematic block-diagram of an audio-based line fault detection system 600 according to some variants as described herein.

In this example, the audio sensors 102, the video/image sensors 104, the frame selector 106, the sound profiler 110, the line fault detector 118 and the game status interface 120 remain on site. The cloud part 602 comprises the frame analyzer 108, the bounce type identifier 114, the bounce learning unit 112 and bounce profile database 116. This means that only the bounce identification-related and the frame analyzer functionalities are moved to the cloud.

Figure 7:
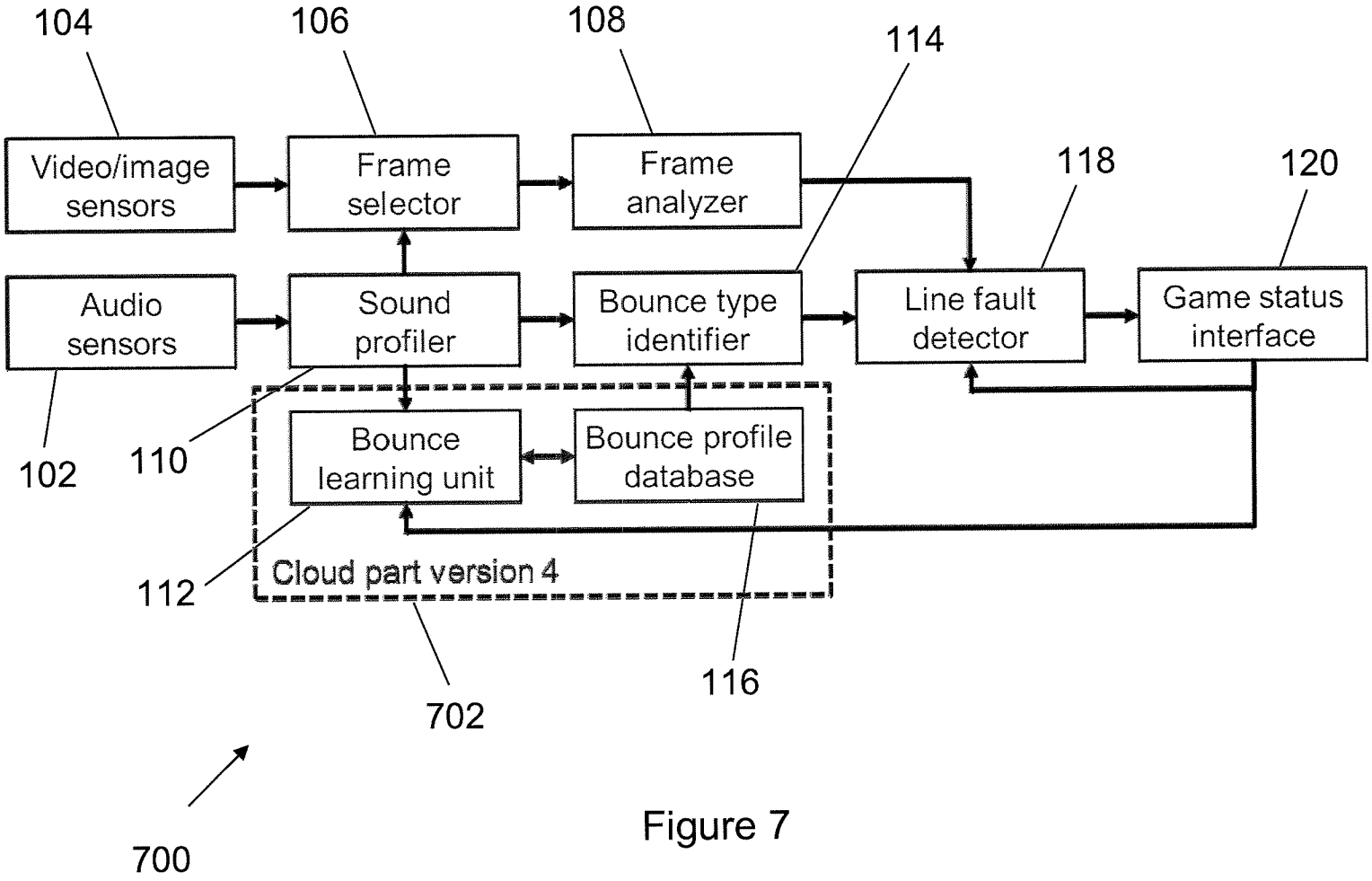
FIG. 7 shows a schematic block-diagram of an audio-based line fault detection system according to some variants of the present disclosure.

FIG. 7 shows a schematic block-diagram of an audio-based line fault detection system 700 according to some variants as described herein.

In this example, the cloud part 702 merely comprises the bounce learning unit 112 and bounce profile database 116. These are those functionalities of the audio-based line fault detection system which may have such an intelligence which may be minimally required if the data and knowledge sharing capabilities may be utilized in case of a cloud implementation.

Figure 8:
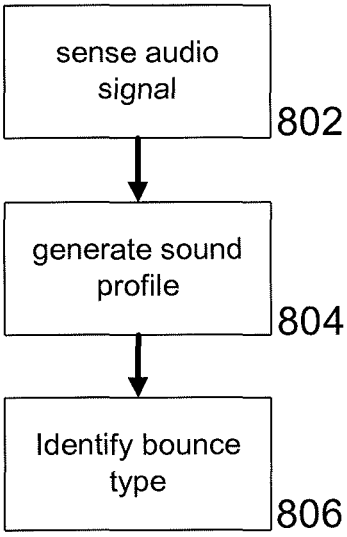
FIG. 8 shows a flow-diagram of a method for determining whether a sports gaming device has bounced off a certain area of a sports field according to some variants of the present disclosure.

FIG. 8 shows a flow-diagram 800 of a method for determining whether a sports gaming device has bounced off a certain area of a sports field according to some variants as described herein.

At step 802, an audio signal generated by the sports gaming device bouncing off the sports field is sensed. At step 804, a sound profile is generated from the sensed audio signal. At step 806, the bounce type is identified based on the generated sound profile. The bounce type is defined by whether or not the sports gaming device has bounced off the sports field where surface modifications have been applied, whereby the audio signal generated by the sports gaming device bouncing off the sports field is dependent on whether the sports gaming device has bounced off the sports field in an area or a location on which surface modifications as described above have been applied.

Figure 9:
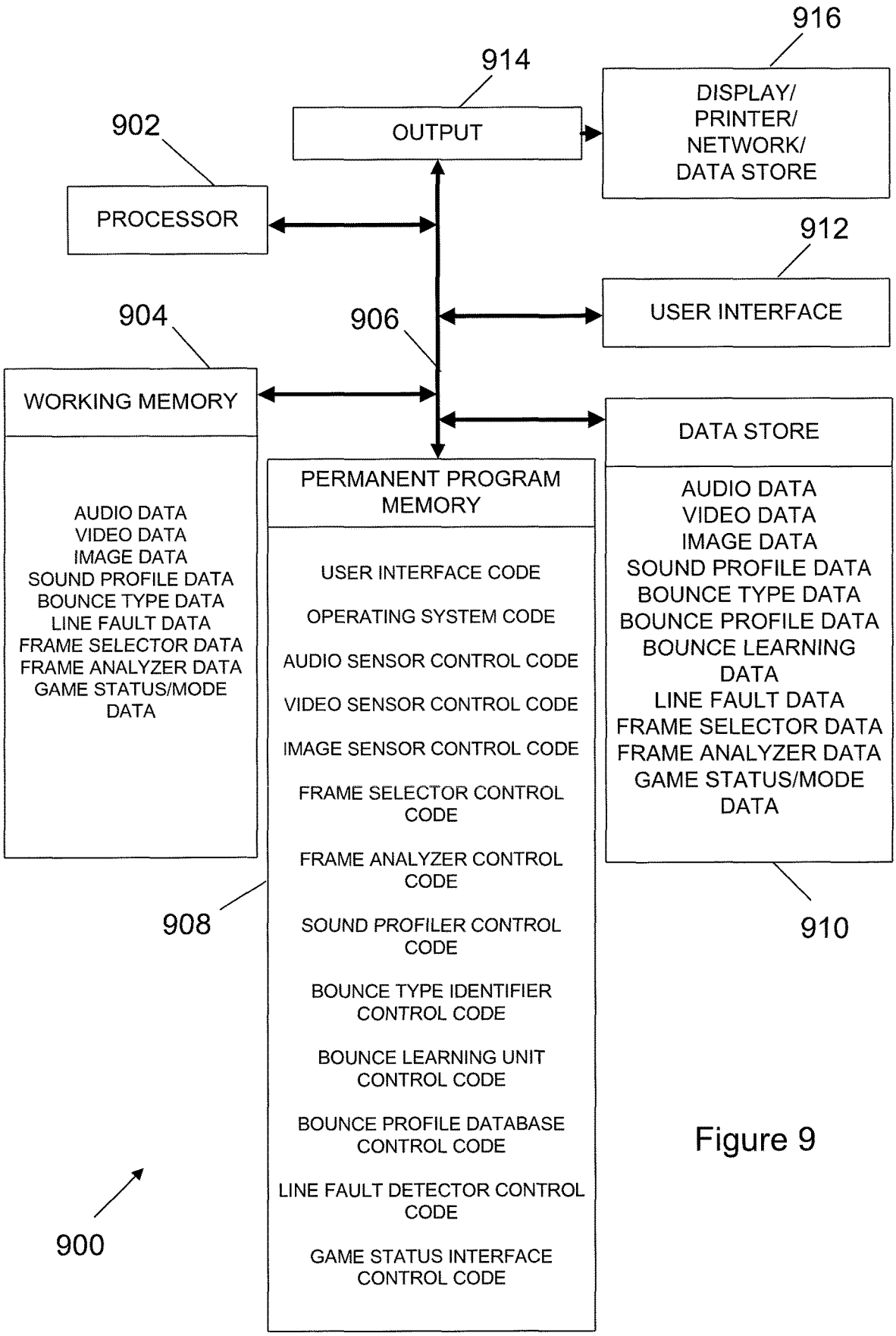
FIG. 9 shows a schematic block-diagram of a system according to some variants of the present disclosure.

FIG. 9 shows a schematic block-diagram of a system 900 according to some variants as described herein.

Broadly speaking, the system 900 comprises a suitably programmed general purpose processor 902. The system 900 comprises processor 902, working memory 904, permanent program memory 908, and a data store 910 all linked by a common data line (bus) 906. In this example, a user interface 912 is also provided for configuring the system 900. User interface 912 can also be used as an input to receive, for example, one or more of audio data, video data, image data, sound profile data, bounce type data, line fault data, frame selector data, frame analyzer data and game status and/or mode data. The system 900 also includes an output 914 connected to one or more of a display, a printer, a data store and a network (for example a cloud) 916 in order to display, store, print or distribute, for example, any one or more of audio data, video data, image data, sound profile data, bounce type data, line fault data, frame selector data, frame analyzer data and game status and/or mode data.

The skilled person will appreciate that additionally or alternatively other forms of storage/output may be employed.

In this example, working memory 904 is used for holding (which may be transient), processing and manipulating audio data, video data, image data, sound profile data, bounce type data, line fault data, frame selector data, frame analyzer data and game status and/or mode data.

Permanent program memory 908 stores operating system code (which can be platform independent) comprising (optional) user interface code, operating system code, audio sensor control code for controlling one or more audio sensors, video sensor control code for controlling one or more video sensors, image sensor control code for controlling one or more image sensors, frame selector control code for controlling the frame selector, frame analyzer control code for controlling the frame analyzer, sound profiler control code for controlling the sound profiler, bounce type identifier control code for controlling the bounce type identifier, bounce learning unit control code for controlling the bounce learning unit, bounce profile database control code for controlling the bounce profile database, line fault detector control code for controlling the line fault detector, and game status interface control code for controlling the game status interface.

These codes are loaded and implemented by processor 902 to provide corresponding functions for the system 900.

Some or all of these codes may be provided on a carrier medium, which may be a removable storage medium, for example a CD-ROM.

Data store 910 stores audio data obtained via the one or more audio sensors, video data obtained via the one or more video sensors, image data obtained via the one or more image sensors, sound profile data obtained via the sound profiler, bounce type data obtained via the bounce type identifier, bounce profile data obtained via the bounce profile database, bounce learning data obtained via the bounce learning unit, line fault data obtained via the line fault detector, frame selector data obtained via the frame selector, frame analyzer data obtained via the frame analyzer, and game status and/or mode data obtained via the game status interface.

The present disclosure further provides processor control code to implement the above-described systems and methods, for example on a general purpose computer system or on a digital signal processor (DSP). The code is provided on a non-transitory physical data carrier such as a disk, CD- or DVD-ROM, programmed memory such as non-volatile memory (e.g. Flash) or read-only memory (Firmware). Code (and/or data) to implement variants of the present disclosure may comprise source, object or executable code in a conventional programming language (interpreted or compiled) such as C, or assembly code, or code for a hardware description language. As the skilled person will appreciate, such cold and/or data may be distributed between a plurality of coupled components in communication with one another.

Figure 10:
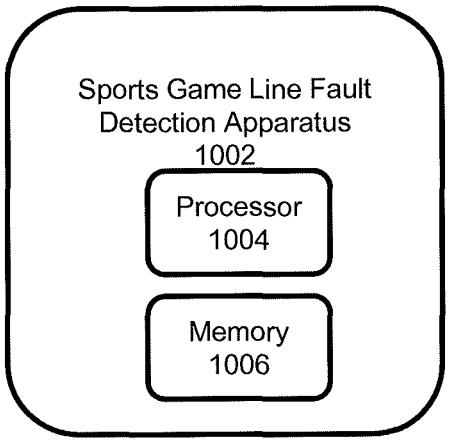
FIG. 10 shows a schematic block-diagram of a sports game line fault detection apparatus according to some variants of the present disclosure.

In order to realize the above and further functionalities regarding the detection of a line fault, a sports game line fault detection apparatus 1002 is provided in embodiments, as shown in FIG. 10.

The sports game line fault detection apparatus 1002 comprises a processor 1004 and a memory 1006. The memory 1006 is coupled to the processor 1004 and comprises program code portions that allow detecting a line fault according to embodiments as described herein upon executing the program code portions.

Figure 11:
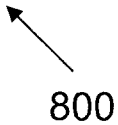
FIG. 11 shows a further schematic block-diagram of a sports game line fault detection apparatus according to some variants of the present disclosure.
Figure 11:
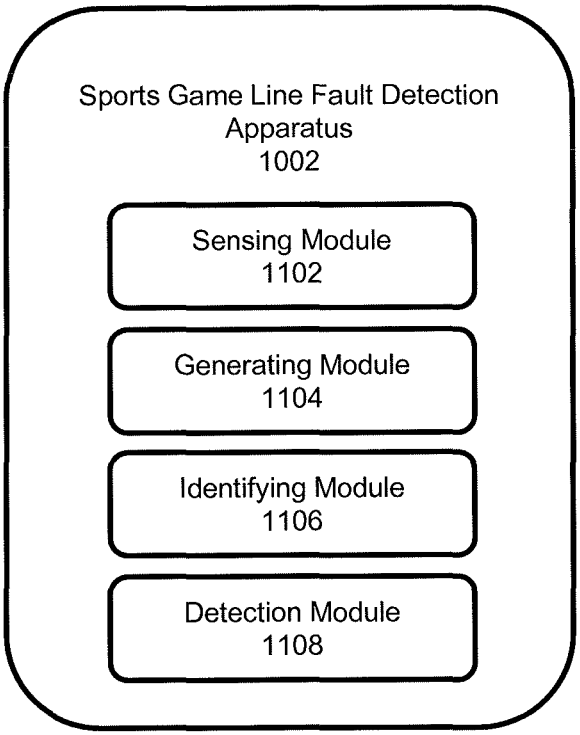

In a further exemplary implementation illustrated in FIG. 11, embodiments of the method for determining whether a sports gaming device has bounced off an area of a sports field to determine a line fault use the sports game line fault detection apparatus 1002, which comprises a sensing module 1102, a generating module 1104, an identifying module 1106 and a detection module 1108. The modules 1102, 1104, 1106 and 1108 may be configured as hardware entities or may be stored as computer program code in the memory 1006.

The audio-based line fault detection system generally as described herein with regard to various implementations and variants may be deployed on existing sports fields with minor influence on the sports field or court itself. Variants of the audio-based line fault detection system may be particularly suitable for hard-cover sports and game fields.

Variants of the audio-based line fault detection system advantageously allow keeping costs to a minimum as no extra maintenance costs on the game or sports field may have to be incurred.

Variants of the audio-based line fault detection system may equally be suitable for indoor and outdoor environments. For example, lightning conditions may have no impact on the audio-based line fault detection system, as opposed to existing optical and video-based solutions which may be influenced, for example, by lightning.

Variants of the audio-based line fault detection system are also comparatively cheap compared to all existing alternatives which may envisage mass market deployment.

Furthermore, in some variants of the audio-based line fault detection system in which some of the functionalities of the system are implemented in the cloud, there may not be a need for computing units in each court or sports/game field of a sports facility. The sound analytics and the video hint calculation may be performed both on site or in the cloud.

Variants of the audio-based line fault detection system and the audio processing methodology may be applied to detect line faults without the need to apply mechanically different materials inside and outside of the game/sports field. As such, no bad interference with the players' safety may be guaranteed. The sound of the ball bounce may be differentiated by an automated decision-making based on sound pattern recognition, machine learning or similar technologies.

As outlined above, the audio part may be extended with a video hint apparatus which may be configured, based on the hints from the audio system, to collect relevant video frames and/or sequences of images in order to judge the line fault even with an automated valuation system.

Variants of the audio-based line fault detection system may be applied to various games and sports, such as tennis, volleyball, squash, and other sports or games.

No doubt many other effective alternatives will occur to the skilled person. It will be understood that the present disclosure is not limited to the described variants and encompasses modifications apparent to those skilled in the art and lying within the scope of the claims appended hereto.

The invention claimed is:

1. An audio-based line fault detection system for a sports game, the audio-based line fault detection system comprising:

one or more audio sensors for sensing an audio signal generated by a sports gaming device bouncing off a sports field, wherein the sports field comprises a pattern of textured surface modifications formed in or on a surface of the sports field and applied to at least one of a line and an area adjacent to the line on the sports field such that the generated audio signal is dependent on whether or not the sports gaming device bounces off the sports field where the pattern of textured surface modifications are applied; and circuitry configured to:

generate a sound profile from the sensed audio signal; and identify a bounce type based on the generated sound profile, wherein the bounce type is defined by whether or not the sports gaming device has bounced off the sports field where the pattern of textured surface modifications are applied.

2. The audio-based line fault detection system of claim 1, wherein the circuitry comprises:

a sound profiler coupled to the one or more audio sensors, the sound profiler configured to generate the sound profile from the audio signal sensed by the one or more audio sensors; and bounce type identifier circuitry coupled to the sound profiler, the bounce type identifier configured to identify the bounce type based on the sound profile.

3. The audio-based line fault detection system of claim 1, wherein the one or more audio sensors are directed substantially towards the pattern of textured surface modifications.

4. The audio-based line fault detection system of claim 1, wherein the circuitry is configured to:

generate a plurality of sound profiles, wherein one of the sound profiles is generated from the audio signal sensed by a corresponding, respective one of the audio sensors;

select one or more of the sound profiles based on one or more characteristics of at least one of the audio signals and the sound profiles; and identify the bounce type based on the selected sound profile.

5. The audio-based line fault detection system of claim 1, wherein the circuitry is configured to determine whether there is a line fault or not based on a status and/or a mode of the sports game, and based on the bounce type.

6. The audio-based line fault detection system of claim 2, wherein the circuitry further comprises a line fault detector configured to determine whether there is a line fault or not based on a status and/or a mode of the sports game, and based on the bounce type.

7. The audio-based line fault detection system of claim 6, further comprising a game status interface configured to indicate the status and/or the mode of the sports game, and to provide the status and/or the mode of the sports game to the line fault detector.

8. The audio-based line fault detection system of claim 2 further comprising:

a bounce profile database coupled to the bounce type identifier circuitry, wherein the bounce profile database is configured to store one or more characteristics of one or more bounce types; and wherein the bounce type identifier circuitry is configured to identify the bounce type based on the one or more characteristics of the one or more bounce types.

9. The audio-based line fault detection system of claim 8, wherein one of the one or more characteristics of the one or more bounce types comprises a plurality of variants for the corresponding bounce type.

10. The audio-based line fault detection system of claim 1, further comprising bounce type learning circuitry configured to learn, based on the sound profile, what bounce type was identified.

11. The audio-based line fault detection system of claim 7 further comprising:

bounce type learning circuitry configured to learn, based on the sound profile, what bounce type was identified;

wherein the game status interface is coupled to the bounce type learning circuitry; and wherein the bounce type learning circuitry is configured to learn, based on at least the status and/or the mode of the sports game, what bounce type was identified.

12. The audio-based line fault detection system of claim 1, further comprising:

one or more optical sensors configured to capture video and/or images of at least a part of the sports field; and frame selector circuitry coupled to the one or more optical sensors;

wherein the frame selector circuitry is configured to extract a frame from the video and/or a sequence from the images; and wherein the frame and/or sequence comprises parts of the video or images captured before and after the sports gaming device bouncing off the sports field.

13. The audio-based line fault detection system of claim 12 further comprising:

a sound profiler coupled to the one or more audio sensors, the sound profiler configured to generate the sound profile from the audio signal sensed by the one or more audio sensors; and bounce type identifier circuitry coupled to the sound profiler, the bounce type identifier configured to identify the bounce type based on the sound profile;

wherein the frame selector circuitry is coupled to at least one of the one or more audio sensors and the sound profiler;

wherein the frame selector circuitry is configured to extract the frame and/or the sequence in response to the audio signal being sensed by at least one of the one or more audio sensors and the sound profile being generated by the sound profiler.

14. The audio-based line fault detection system of claim 12, further comprising analyzer circuitry configured to determine, from the frame or sequence, a location on the sports field on which the sports gaming device has bounced off.

15. The audio-based line fault detection system of claim 14, wherein the analyzer circuitry is configured to determine the location on the sports field on which the sports gaming device has bounced off based on an interpolation using the frame extracted from the video or the sequence extracted from the images, and further using speed information of the sports gaming device before and after the bounce.

16. The audio-based line fault detection system of claim 2, wherein the one or more audio sensors are configured to provide the sensed audio signal to the sound profiler in a compressed format.

17. The audio-based line fault detection system of claim 1 wherein the pattern of textured surface modifications are formed into or on a surface of the sports field and comprise one or more of:

a cut;

a hole;

an indent;

an elevation;

a dashed painting; and a dotted painting.

18. The audio-based line fault detection system of claim 1 wherein a size of the textured surface modifications does not exceed a predetermined threshold size and is selected based on a type of the sports gaming device.

19. A sports facility, comprising:

a sports field comprising a pattern of textured surface modifications formed in a surface of the sports field and applied to at least one of a line and an area adjacent to the line on the sports field such that an audio signal generated by a sports gaming device bouncing off the sports field is dependent on whether or not the sports gaming device bounces off the pattern of sports field where the pattern of textured surface modifications are applied; and an audio-based line fault detection system for a sports game, the audio-based line fault detection system comprising:

one or more audio sensors for sensing the audio signal generated by the sports gaming device bouncing off the sports field; and circuitry configured to:

generate a sound profile from the sensed audio signal; and identify a bounce type based on the generated sound profile, wherein the bounce type is defined by whether or not the sports gaming device has bounced off the sports field where the pattern of pattern of textured surface modifications are applied.

20. A method for determining whether a sports gaming device has bounced off an area of a sports field, the method comprising:

sensing an audio signal generated by the sports gaming device bouncing off the sports field, wherein the area comprises a pattern of textured surface modifications formed in or on a surface of the sports field and applied to at least one of a line and an area adjacent to the line on the sports field such that an audio signal generated by the sports gaming device bouncing off the sports field is dependent on whether or not the sports gaming device has bounced off the area of the sports field on which the pattern of textured surface modifications have been applied;

generating a sound profile from the sensed audio signal; and identifying a bounce type based on the generated sound profile, wherein the bounce type is defined by whether or not the sports gaming device has bounced off the sports field where the pattern of textured surface modifications have been applied.

* * * * *